US006464786B1

(12) United States Patent
Hopson

(10) Patent No.: US 6,464,786 B1
(45) Date of Patent: Oct. 15, 2002

(54) MECHANICAL FAIRING SYSTEM

(76) Inventor: Frederick M. Hopson, 410 W. 7 th St., #224, Tulsa, OK (US) 74119

( * ) Notice: Subject to any disclaimer, the term of this patent is extended or adjusted under 35 U.S.C. 154(b) by 69 days.

(21) Appl. No.: 09/589,686

(22) Filed: Jun. 9, 2000

(51) Int. Cl.[7] ..... B05C 13/02
(52) U.S. Cl. ..... 118/500; 118/505
(58) Field of Search ..... 118/500, 505; 264/267; 425/12, 117, 129.1; 269/21, 22

(56) References Cited

U.S. PATENT DOCUMENTS 3,988,400 A * 10/1976 Luhman, II ..... 364/267
5,975,183 A * 11/1999 Reis et al. ..... 156/580
6,328,797 B1 * 12/2001 Parzych et al. ..... 118/500

* cited by examiner

*Primary Examiner*—Laura Edwards
(74) *Attorney, Agent, or Firm*—Roland O. Cox

(57) ABSTRACT

Devices and an improved system for fairing or producing smooth surfaces. Rails positioned on and attached to the surfaces are used to form guide strips on the surface which are made of filler. A straight edge is moved over the guide strips to fair and smooth the filler applied between the guide strips.

8 Claims, 4 Drawing Sheets

MECHANICAL FAIRING SYSTEM

CROSS-REFERRENCE TO RELATED APPLICATIONS

Not Applicable

BACKGROUND—FIELD OF INVENTION

This invention is related to the fairing process, specifically used to produce even and smooth surfaces on boats and yachts.

BACKGROUND—DESCRIPTION OF PRIOR ART

Fairing is a term used to define the process of applying a compound which acts as a filler to the surface of a yacht or other structures with the objective of producing an even smooth, and consistent surface that follows the shape of the structure. Fairing is necessary due to the warping and distortion caused by welding and fabrication during construction. Composite structures also have distortion and recesses caused by poor molds, and from the joining of molded pieces. Also the paint that is applied as a finish coating on the surface is usually a high gloss paint and any imperfections or recesses that are not filled on these surfaces will be clearly visible after this finish coating is applied. The present method of fairing is to apply the filler on the surface to be faired using a straight edge. A straight edge is usually made of metal or any material that can provide a sturdy and yet flexible edge which tends to be straight The straight edge is then moved over the filler on the area to be faired with the desired results being a consistently smooth and even surface. The principle is similar to the use of a putty knife, but on a much larger scale.

The ideal situation would be to be able to fill the largest area possible at one time. Unfortunately this is limited by the present method of fairing. Normally straight edges are an approximate maximum length of 18 ft. One of the problems with using a straight edge of this length or longer is that it will not remain rigid and yet flexible enough to bend to the shape of the surface. Straight edges of this length also have the tendency to be pushed out by the filler due to the density of the filler; thus, causing the filled area to be convex. In certain areas where the curvature is minimal it would be possible to use a longer straight edge, but the straight edge would be awkward, bulky, and heavy. Manufacturing such a straight edge would be impractical due to the numerous areas that have different curvature and shape; thus, different degrees of rigidness and flexibility would be required.

The main disadvantage with the present process is the inability to apply the filler accurately due to the uneveness of the surface. The high or protruding areas on the surface are used as a guide to push against when moving the straight edge over the filler on the surface. As a rule these high areas are not uniform; therefore, the high areas do not act as a desirable guide to push the straight edge against. The result is an uneven surface that will require numerous applications of filler and extensive sanding as well to produce a consistently even and smooth surface. The area will also need to be filled vertically as well as horizontally.

Some recessed areas can reach lengths of 40 ft. or more and with a depth of 4 in. or more. This situation represents an inability to fill or check the recessed areas accurately. Repeated filling and extensive sanding will be necessary requiring much knowledge and experience in fairing.

SUMMARY

In accordance with the present invention is a system with devices that will form guide strips made of the same filler, which will be used to fair the surface. These guide strips made of filler will provide accurate guides for the straight edge to rest on while moving over the filler that is applied between the guide strips. These guide strips will lay horizontally so that the straight edge can be placed vertically and moved horizontally over the filler; thus, eliminating the need for a lengthy straight edge. In some situations where it would be more advantageous to fill vertically the guide strips may be formed vertically for vertical guided movement of the straight edge.

OBJECTS AND ADVANTAGES

The objective of my invention is to produce a system with devices that is efficient and applicable to various surfaces for the purpose of fairing surfaces. Accordingly several objects and advantages of my invention are:

A) would be inexpensive to implement;

B) would substantially reduce the amount of time required to fair surfaces;

C) would enable the worker to know where and how much filler to apply; therefore, eliminating wastage of filler;

D) would enable the worker to apply the filler evenly and accurately; thus reducing the amount of time used for sanding, and the amount of sandpaper consumed;

E) would simplify the fairing process; therefore, reducing the number of skilled workers required; and F) would be applicable to numerous shapes and curvatures.

These and other objects and advantages from my invention will become apparent from consideration of the ensuing description and drawings.

DRAWING FIGURES

Figure 3:
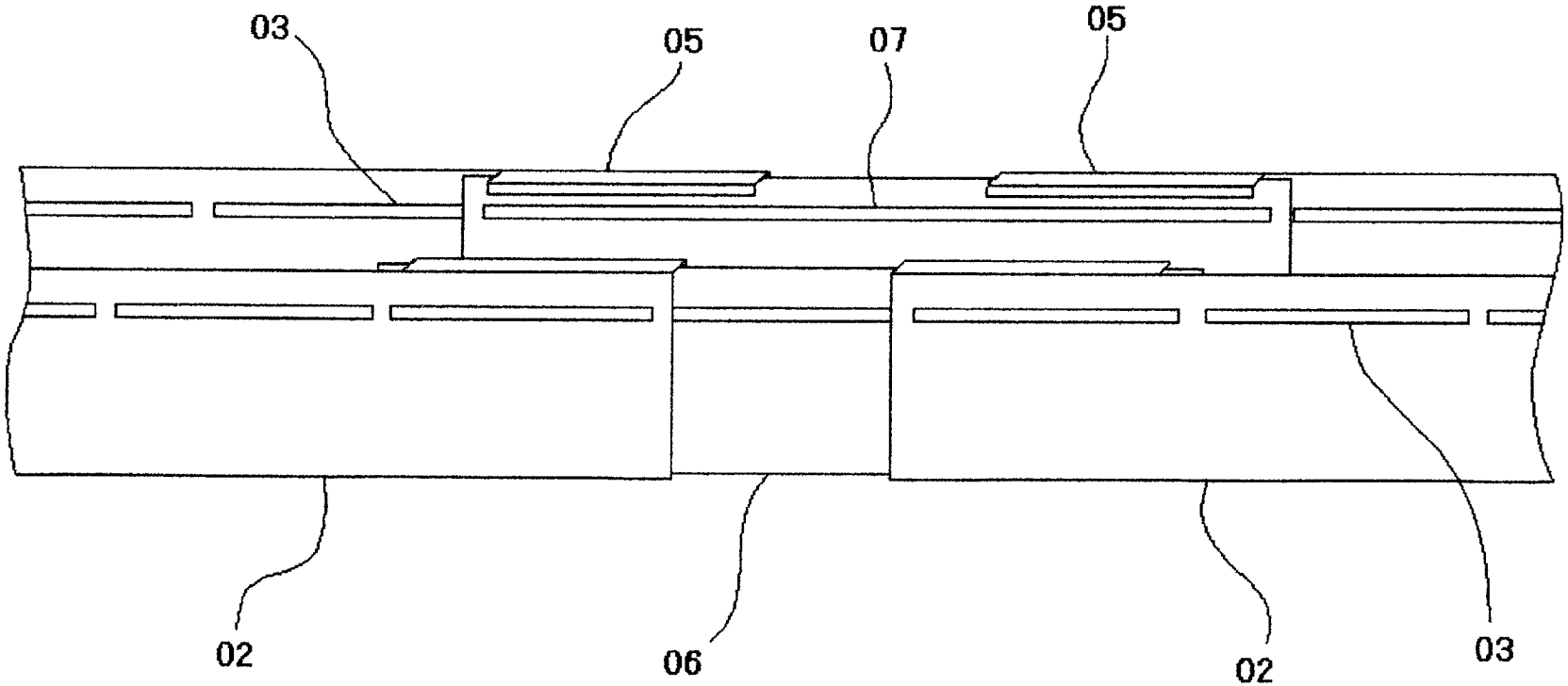

In FIG. 3 a schematic drawing shows a portion of two rails one on each end of a connector, with the connector inserted under the flanges of each rail.

Figure 4:
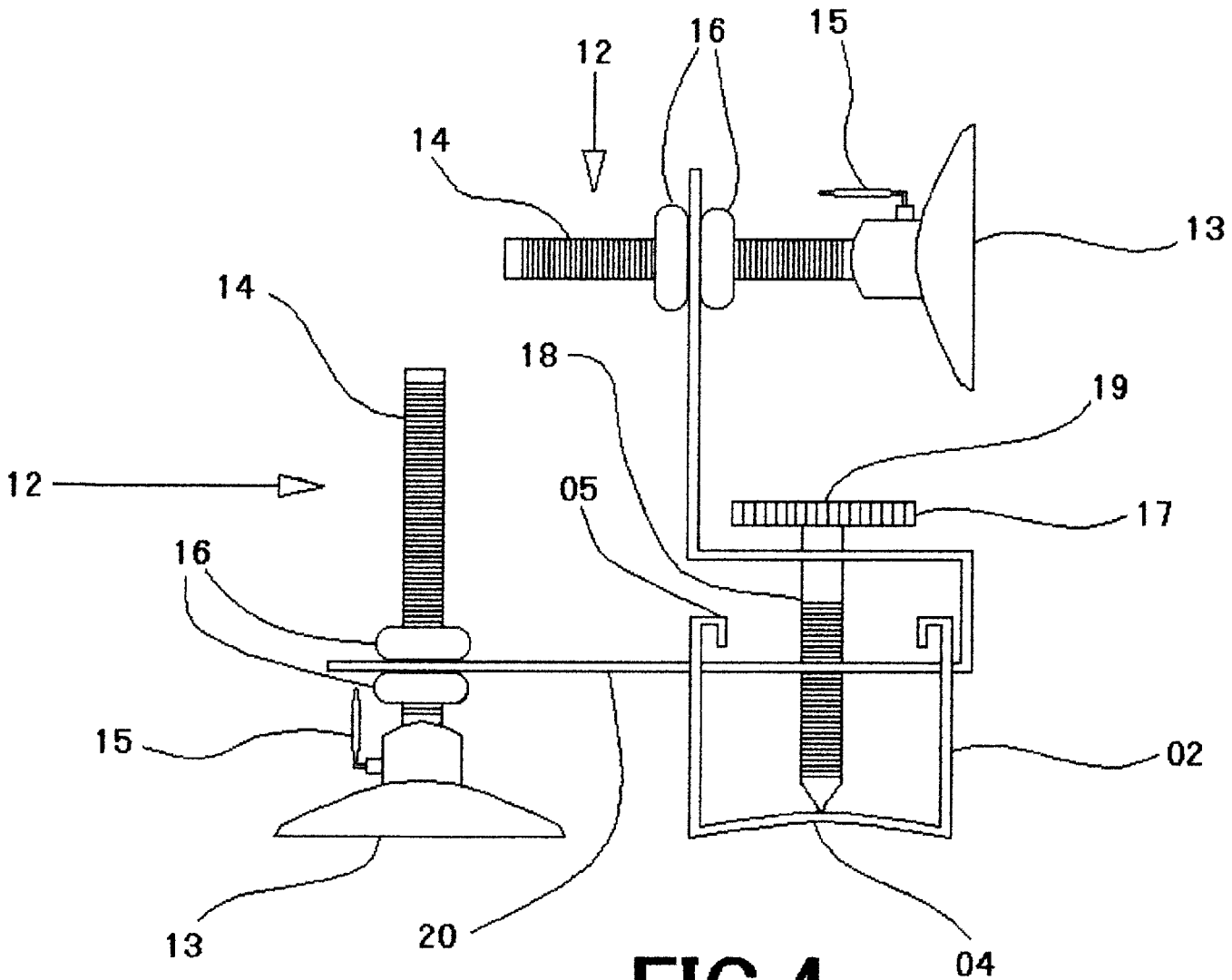

FIG. 4 is a schematic drawing showing an end view of a rail, an angle supporter, two positioners, and an adjuster assembled together.

| REFERENCE NUMERALS IN DRAWINGS | |
|---|---|
| 02) | RAIL |
| 03) | RAIL SLOTS |
| 04) | CONCAVE SURFACE |
| 05) | RAIL FLANGES |
| 06) | CONNECTOR |
| 07) | CONNECTOR SLOTS |
| 08) | CONCAVE SURFACE |
| 09) | SUPPORTER |
| 10) | HOLES |
| 11) | HOLE |
| 12) | POSITIONER |

-continued

| REFERENCE NUMERALS IN DRAWINGS | |
|---|---|
| 13) | SUCTION CUP |
| 14) | POSITIONER SHAFT |
| 15) | LOCKING MECHANISM |
| 16) | NUTS |
| 17) | ADJUSTER |
| 18) | ADJUSTER SHAFT |
| 19) | HANDLE |
| 20) | ANGLE SUPPORTER |
| H) | BOAT HULL |

DESCRIPTION—1 TO 4—PREFERRED EMBODIMENT

Figure 1:
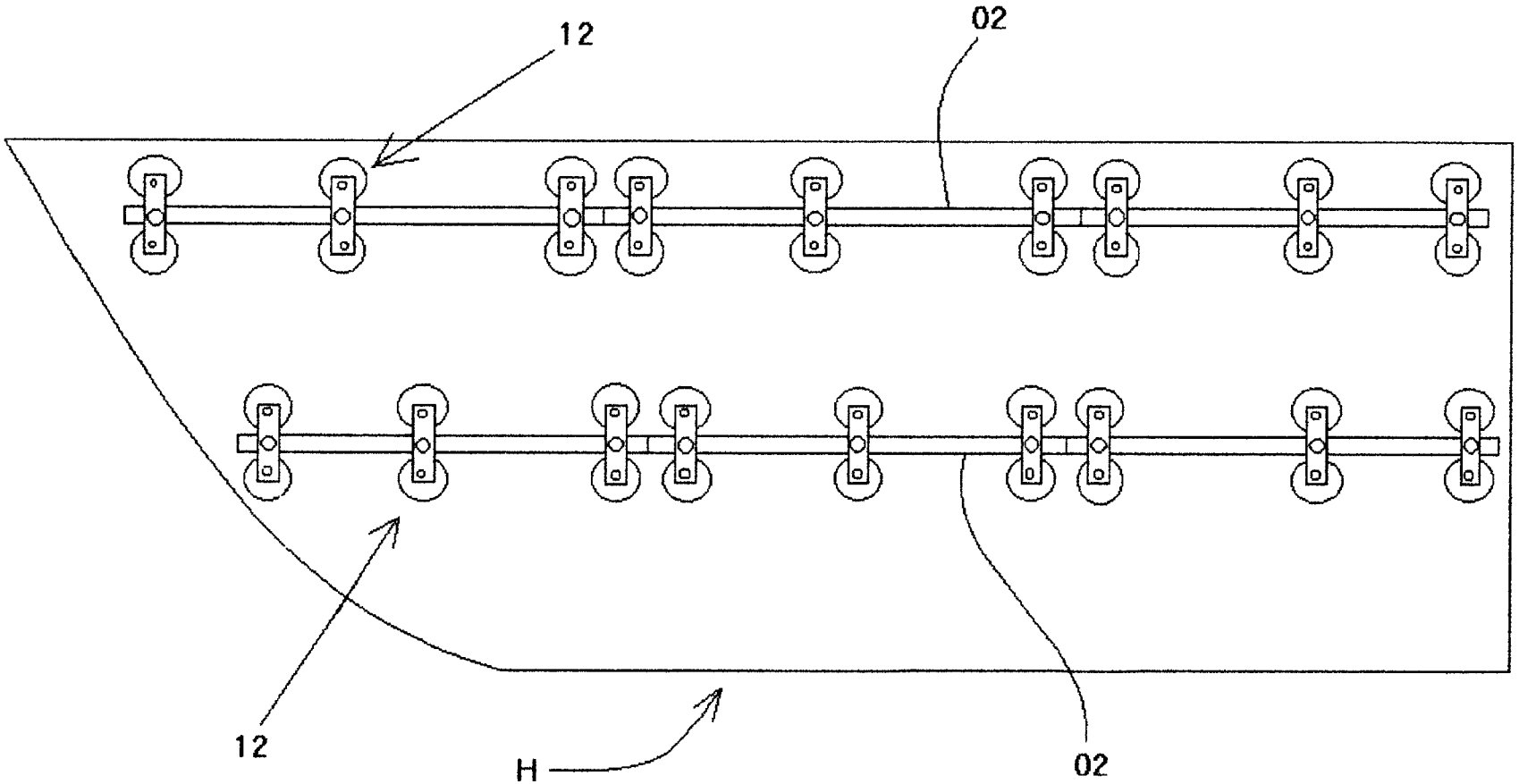
FIG. 1 is a schematic drawing showing two parallel sets of the devices of the invention positioned on and attached to a surface of a boat hull H for the purpose of carrying out the system of this invention.

A preferred embodiment of the present invention is illustrated in FIG. 1. Two sets of rails 02 are shown positioned on and attached to a surface of a boat hull H by positioners 12. The two sets of rails 02 are parallel to each other, one upper set of rails 02 and one lower set of rails 02.

Figure 2:
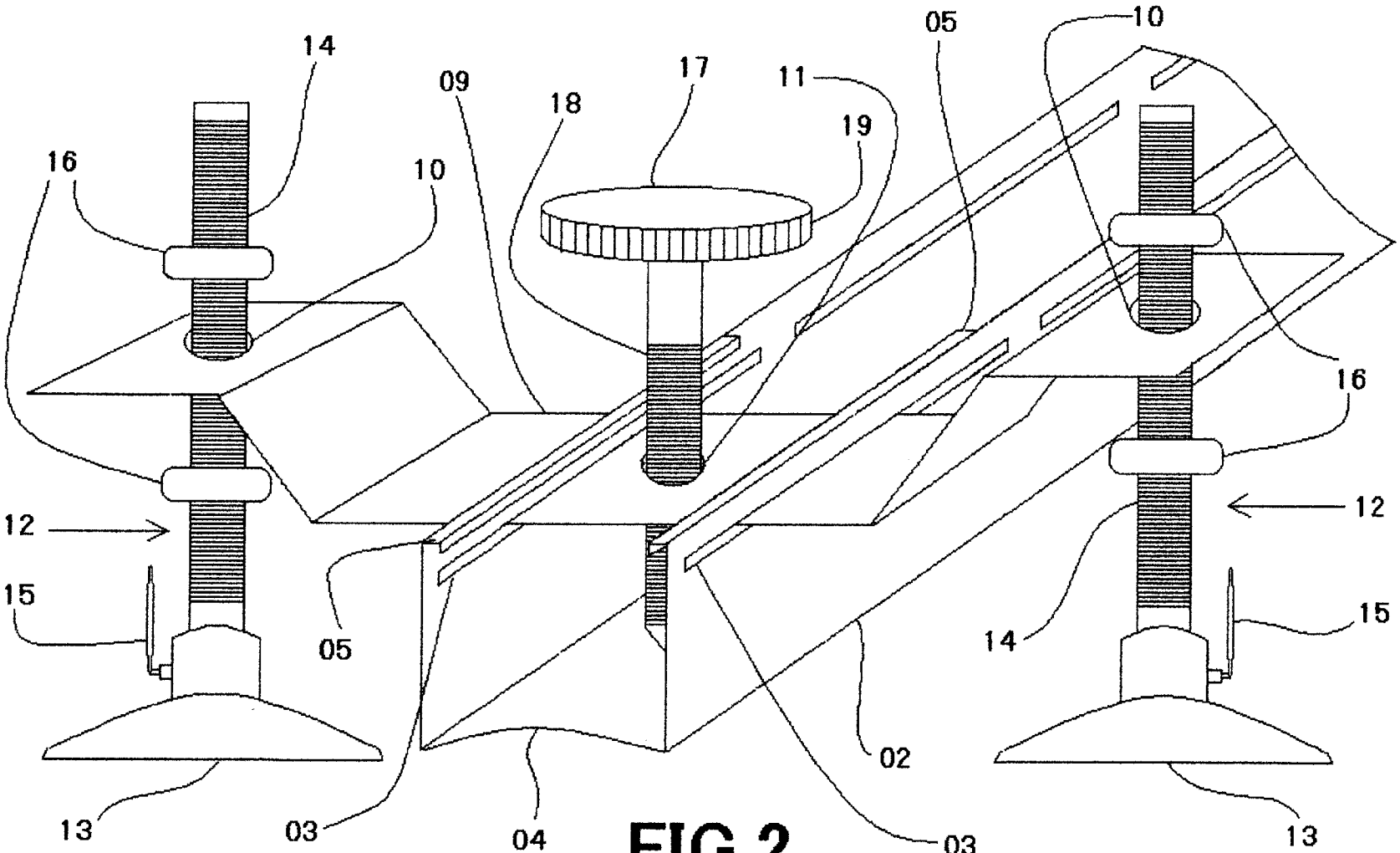
FIG. 2 is a schematic drawing showing a portion of a rail with a supporter, two positioners, and an adjuster assembled together.

FIG. 2 shows a portion of a rail 02 with a supporter 09, two positioners 12, and an adjuster 17 assembled together. The opposite sides of the rail 02 have a series of slots 03 in each side. There are flanges 05 on the inside faces of the opposite sides of the rail 02. These flanges 05 extend inward from the corner of the rail 02. The concave side 04 of the rail 02 is coated with a non-stick material such as teflon or paint. A supporter 09 is shown inserted through the rail slots 03. The supporter 09 may be flat or with bends as illustrated. There are two holes 10 and a threaded hole 11 on the supporter 09. Each positioner 12 consists of a suction cup 13 with a locking mechanism 15, and a threaded shaft 14 attached. The supporter 09 is secured at the proper height using nuts 16 which are threaded onto the positioners shaft 14. One nut 16 against the top of the supporter 09, and the other nut 16 against underside of the supporter 09. Threaded into the hole 11 of the supporter 09 is an adjuster 17. An adjuster 17 has a threaded shaft 18 with a handle 19 on one end, and pointed on the other end. The adjuster 17 will provide additional stability to the assembly.

FIG. 3 shows a portion of two rails 02 one on each end of the connector 06. The rails 02 are pulled apart to show the connector 06 which is inserted under the flanges 05 of the rails 02. A connector 06 is a short U-channel. On each of the opposite sides of the connector 06 is a slot 07 which will coincide with the rail slots 03 when inserted into the rail 02. The concave side 08 of the connector 06 coincides with the concave side 04 of the rail 02 when inserted into the rail 02. A connector 06 is used when joining two rails 02 together. The connector 06 slides under the flanges 05 on the rails 02 with an equal distance inserted into each rail 02. Where the connector 06 is used to join two rails 02 it will be necessary to insert the supporter 09 or angle supporter 20 into both the rail slots 03 and the connector slots 07 simultaneously.

In FIG. 4 an angle supporter 20 is shown in the assembly, replacing the supporter 09 shown in FIG. 2. An angle supporter 20 is a modified supporter 09 that is angled for use on comers edges, and areas that is not accessible to the supporter 09.

In this description metal is the preferred material that is used for the rails 02, connectors 06, supporters 09, and angle supporter 20. However they can be made of any material that produce the same results. For example; composites such as graphite or fiberglass, or various metals. The dimensions of a rail 02, connector 06 supporter 09, and angle supporter 20 will need to be decreased or increased according to the rigidness or flexibility required. This will depend on the length and the curvature of the surface.

DESCRIPTION OF OPERATION

The manner of using the mechanical fairing system is unique in that it forms accurate guide strips made of filler for the straight edge to be placed against. The first step is to determine how many rails 02 will be required. This is determined by the length of the surface. If more than one rail 02 is required then it will be necessary to join the rails 02 with the connector 06. The rails 02 are placed end to end with the connector 06 inserted under the flanges 05 on both rails 02 as illustrated in FIG. 3. The connector slots 07 will be in alignment with the rail slots 03. The supporter 09 is then inserted through the rail slots 03 along the rail 02. Where the rails 02 are joined with the connector 06 it will be necessary to insert the supporter 09 through the rail slots 03 and the connector slots 07 simultaneously. The supporter 09 will extend equal distances on the outsides of the rails 02. The positioners shaft 14 is inserted into each of the holes 10 of the supporter 09. The suction cups 13 on the positioners 12 are then secured on the surface using the locking mechanism 15. One nut 16 on the positioners shaft 14 is tightened against the top of the supporter 09 and one nut 16 against the underside of the supporter 09. This will secure the rails 02 at the desired height. The adjuster 17 is then threaded into the hole 11 of the supporter 09. The adjuster 17 is then tightened downward against the connector 06 or rail 02 which will give additional stability where the rail 02 supporter 09, and the connector 08 are used.

The rails 02 when placed against a distorted surface will rest on the protruding or high areas on the surface. The suction cups 13 on the positioners 12 are secured on these protruding areas using the locking mechanism 15. It will be necessary to position at least two sets of rails 02 running parallel to each other the length of the surface and separated by an approximate distance of 4 ft–8 ft. In some situations it will be necessary to assemble more than two sets of rails 02 depending on the height and the curvature of the surface. After two or more sets of rails 02 are secured on the surface at the desired height, then mark the position of the suction cups 13 on the surface. Remove the assembly by unlocking the suction cups 13.

Apply filler amply in a continuous fine between the marked positions of the suction cups 13 on the area the rails 02 occupied. The concave side 04 of the rail 02 is placed on top of the filler while lining up the suction cups 13 on the marked positions. When the suction cups 13 are on the marked positions, secure the suction cups 13 on the surface using the locking mechanism 15. After the filler has dried sufficiently remove the entire assembly. The non-stick coating on the concave side 04 of the rail 02 ensures that there is no adhesion between the filler and the rails 02. Remaining on the surface will be guide strips made of filler that follow the contour of the structure. The concave side 04 of the rail 02 will form beveled edges on the filler under the rails 02.

Using the same filler that was used to form the guide strips under the rails 02, apply filler between the guide strips. Use a straight edge longer than the distance between the guide strips. Then pressing the straight edge on the guide strips made of filler hold the straight edge vertically while moving the straight edge horizontally over the filler. This process will produce an even and smooth surface that follows the curvature of the structure, and will not require extensive filling or extensive sanding.

CONCLUSIONS, RAMIFICATIONS, AND SCOPE

Thus it will become apparent that the devices and system of my invention provides an economical and efficient system for fairing that can be utilized by persons of minimal knowledge and skill in fairing. This system would provide accurate guide strips made of the same filler that is used for fairing the surface, therefore the guide strips would not require removal but would become part of the faired surface. Furthermore my invention has the additional advantages in that it;

1) would substantially reduce man hours consumed during the fairing process;
2) would reduce wastage of materials;
3) would refine the fairing process;
4) would be inexpensive to implement; and
5) would represent substantial savings for boat or yacht builders.

While the description of this invention states many specifics, these should not be construed as limitations on the scope of the invention, but rather as an exemplification of one preferred embodiment. Many variations are possible. For example; the rails 02 and connectors 06 could be various shapes, and would not be restricted to being the shape of a U-channel. The supporter 09 and angle supporter 20 could also be various shapes and angles. The rails 02 can be secured to the surface by other means such as clamps. The rails 02, connectors 06, supporters 09, and angle supporters 20 can be made of other material besides metal. For example; composites such as fiberglass or graphite, or various metals.

Thus the scope of the invention should be determined by the appended claims and their equivalents, rather than by the examples given.

I claim:

1. A device for fairing and smoothing a surface comprising:

a) rails in which an epoxy filler is applied between the surface and said rails to form guide strips on the surface;

b) releasable means attachable between the ends of said rails for positioning on and attaching the rails to the surface, said releasable means including a suction cup having an interior surface, and means for attaching said suction cup to and releasing from the surface, said attaching and releasing means including, a rod extending from said suction cup, a supporter having ends and attachable to said rails, means for positioning said supporter along said rod; and c) connectors for connecting the ends of the rails, together.

2. The releasable means of claim 1 wherein the supporter ends are not in the same plane.

3. The device of claim 1 wherein the positioning means comprise:

a) threads on the rod;

b) a nut on the rod above the supporter; and c) a nut on the rod below the supporter.

4. The device of claim 1 wherein the means for attaching and releasing the suction cup is a lever extending from the suction cup, said lever moveable between positions causing the interior surface of said suction cup to be more concave or less concave.

5. The device of claim 2 wherein the supporter has releasable means connected near either end.

6. The device of claim 1 wherein the rails are channel shaped having slots on opposite sides and a concave surface.

7. The device of claim 6 wherein the concave surface is coated with a non-stick material.

8. The device of claim 1 wherein the connectors are channel shaped and have slots on opposite sides, and a concave surface, said connectors being telescopingly engageable with the ends of the rails.

* * * * *